United States Patent [19]

Lacey

[11] Patent Number: 4,763,728

[45] Date of Patent: Aug. 16, 1988

[54] JET-TYPE WELL SCREEN CLEANER

[76] Inventor: James J. Lacey, P.O. Box 796, Trent, S. Dak. 57065

[21] Appl. No.: 74,156

[22] Filed: Jul. 16, 1987

[51] Int. Cl.[4] ..... E21B 33/124

[52] U.S. Cl. ..... 166/191; 166/312; 134/22.12; 134/167 C

[58] Field of Search ..... 166/312, 191, 222, 72; 134/22.12, 166 C, 167 C, 169 C, 173, 198

[56] References Cited

U.S. PATENT DOCUMENTS

| | | | |
|---|---|---|---|
| 2,512,801 | 6/1950 | Kinney et al. | 166/191 X |
| 2,720,381 | 10/1955 | Quick | 166/312 |
| 2,918,973 | 12/1959 | Ozinga | 166/191 X |
| 3,760,878 | 9/1973 | Peevey | 166/191 X |
| 3,945,436 | 3/1976 | Nebolsine | 166/312 X |
| 4,030,545 | 6/1977 | Nebolsine | 166/312 X |
| 4,484,625 | 11/1984 | Barbee, Jr. | 166/312 X |
| 4,612,986 | 9/1986 | Fosdick, Jr. et al. | 166/312 X |
| 4,694,901 | 9/1987 | Skinner | 166/312 X |

*Primary Examiner*—Jerome W. Massie
*Assistant Examiner*—William P. Neuder

[57] ABSTRACT

A device adapted to clean well screens and to open aquifer formations including high pressure water jets directed at the formation through the screen and including a pumping device to extract the water forced from the jets and to create turbulence to cause washing action, and the method of cleaning the screen comprising directing jets of water through the screen and causing a turbulent washing action by which the screen is washed.

2 Claims, 1 Drawing Sheet

JET-TYPE WELL SCREEN CLEANER

BACKGROUND AND SUMMARY OF THE INVENTION

This invention pertains to a device for use in improving the performance of a well, especially a water well, by forcing a liquid toward the material surrounding the well and through any protective screen and withdrawing the liquid and any entrained substances, and the method of cleaning the screen by causing turbulence in the liquid in the well.

Many wells, especially water wells, are sunk into material such as sand that may readily become clogged with silt or the like. These wells may also use casings that have screens adapted to filter extraneous materials out of the liquid to be pumped from the well. Such screens may also become clogged with silt or sand.

Back flushing of wells is commonly used to clear up such silting problems. The action is partially effective, but does not always clean all of the area desired.

By my invention, I provide a device and a method capable of forcefully washing the screen and of causing a churning action which will assist in making a turbulent scrubbing action to remove silt and other material from the internal surface of the well and also from the screen.

FIGURES

DESCRIPTION

Briefly my invention comprises a device having nozzles adapted to direct high pressure streams of water in a radial direction and having a means adapted to extract that water, thereby causing a churning action in a localized part of the well, and the method of cleaning the well by using the jets to create a turbulent screening action in the well.

Figure 1:
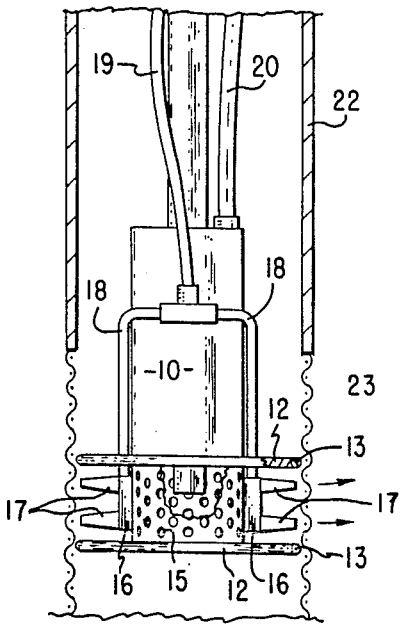
FIG. 1 is an elevational view of the device of my invention, in place.
Figure 2:
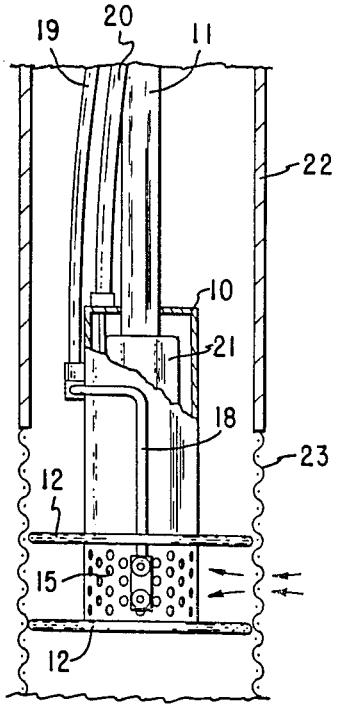
FIG. 2 is a view similar to FIG. 1 from a position 90 degrees spaced around the periphery from FIG. 1.
Figure 3:
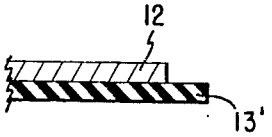
FIG. 3 is a partial sectional view of a plate of my device showing an alternative type of seal.

More specifically and referring to the figures, I provide a container-like housing 10 attached to a stem or pipe 11. Near the bottom of the housing, I provide two plates 12 having a rubber-like edge 13 or 13' adapted to seal the plates against a well casing. The edge may be in the form of an O-ring 13 or the like set into a groove in the edge of the plate 12 or may be a flat washer-like ring 13' (FIG. 3) surrounding the plate 12 and having an edge extending beyond the plate. These plates are made to fit one size of casing, and I envision the possibility of making them replaceable so that my device would be usable in two or three different sizes of well.

Between the two plates 12, the wall of the housing 10 is perforated to form an intake 15. On the exterior of that housing I mount a pair of nozzle holders 16 each of which may carry one or a plurality of nozzles 17 directed in a radial direction away from the housing 10. Pipes 18 leading from the nozzles through a tube 19 connect the nozzles 17 to a source of water under high pressure.

The intake 15 between the plates 12 is perforated so that water and entrained material can flow into the interor of the housing. Within that housing is a motor-driven pump 21 adapted to withdraw the water through the intake 15 and force it out of the well through the pipe 11. Thus, water and any dirt, silt or other material mixed with that water will be withdrawn and forced outward through the pipe 11.

In use, the device is lowered into the casing 22 of the well using the pipe 11 as a stem. The plates 12 may be lubricated with water or other material so that they will slide inside the casing more easily. When the device reaches the level to be cleaned, it is held there and the water under pressure is turned into the jets. The casing in most wells that need cleaning will include a screen 23 intended to prevent complete clogging or refilling of the well by sand, rock or siltation or the like. It is frequently just the screen 23 that needs cleaning although, on occasion, the face of the interior of the well may also need attention.

Usually, that screen 23 is below the level of the water (or other liquid) being pumped from the well. Therefore, when the jets are turned on, the water from those jets may not impinge directly onto the screen 23. Instead it sets up a current that flows rapidly against the screen and beyond. The exhausting of water through the perforated intake 15 and thence pumping it through the pipe 20 causes additional counter currents so there is an irregular circulating current set up which will tend to flush materials off the screen 23 and from the walls of the well beyond the screen. Additional agitation of the water may be set up by moving the device up and down or by turning it, all by use of the stem pipe 11. Because the space between the plates 12 is limited, it may be desirable to use the device at several levels, or to continue moving it vertically across the range of levels needing flushing. It will be apparent that the turbulence in the water will tend to wash loose any silt or other material in the area, and that such material will be washed up into the exhaust pipe and be pumped away.

I claim as my invention:

1. A device for flushing a screen on a well casing comprising a housing means, stem pipe means attached to said housing means by which said housing means can be lowered into said casing, seal means engaged with said housing means and adapted to engage said screen, said seal means including spaced apart members to define a limited area of said screen, nozzle means mounted on said housing between said spaced apart members and adapted to direct a stream of water toward said area of the screen and exhaust means including a perforated portion of said housing within said limited area, pump means connected to said housing adapted to withdraw said water and pipe means engaged with said pump means adapted to carry said water away from said housing.

2. The device of claim 1 in which said spaced apart members engaged with said housing are plate means having flexible sealing means engaged between said plate means and said casing.

* * * * *